US008430100B2

(12) United States Patent
Reese et al.

(10) Patent No.: US 8,430,100 B2
(45) Date of Patent: Apr. 30, 2013

(54) UNIVERSAL FIT FACE MASK

(75) Inventors: George D. Reese, Keller, TX (US); Michael L. Bowen, Richland Hills, TX (US)

(73) Assignee: Prestige Ameritech Ltd., Fort Worth, TX (US)

( * ) Notice: Subject to any disclaimer, the term of this patent is extended or adjusted under 35 U.S.C. 154(b) by 941 days.

(21) Appl. No.: 12/390,744

(22) Filed: Feb. 23, 2009

(65) Prior Publication Data

US 2009/0211582 A1 Aug. 27, 2009

Related U.S. Application Data

(60) Provisional application No. 61/031,119, filed on Feb. 25, 2008.

(51) Int. Cl.
*A62B 18/02* (2006.01)

(52) U.S. Cl.
USPC ..... 128/206.19

(58) Field of Classification Search ..... 128/205.29, 128/206.13, 206.16, 206.17, 206.21, 206.24, 128/206.26, 206.27, 206.28, 207.11, 206.19, 128/205.27, 206.12
See application file for complete search history.

(56) References Cited

U.S. PATENT DOCUMENTS

| | | | | |
|---|---|---|---|---|
| D347,713 | S | 6/1994 | Brunson | |
| 5,322,061 | A | 6/1994 | Brunson | |
| 5,673,690 | A * | 10/1997 | Tayebi et al. | 128/206.24 |
| 5,724,964 | A | 3/1998 | Brunson et al. | |
| 5,727,544 | A * | 3/1998 | Miura | 128/201.13 |
| 5,765,556 | A | 6/1998 | Brunson | |
| 6,055,982 | A | 5/2000 | Brunson et al. | |
| 6,102,040 | A | 8/2000 | Tayebi et al. | |
| 6,928,657 | B2 * | 8/2005 | Bell et al. | 2/9 |
| 7,044,131 | B2 | 5/2006 | Griesbach, III et al. | |
| 8,066,006 | B2 * | 11/2011 | Daugaard et al. | 128/206.16 |
| 2004/0255946 | A1 | 12/2004 | Gerson et al. | |
| 2009/0205666 | A1 * | 8/2009 | Bowen | 128/206.13 |

FOREIGN PATENT DOCUMENTS

| | | |
|---|---|---|
| AU | 527091 | 5/1981 |
| GB | 4789 | 0/1912 |
| GB | 1 556 679 | 11/1979 |
| GB | 1 588 442 | 4/1981 |
| GB | 2 072 516 | 10/1981 |
| GB | 2 103 491 | 2/1983 |

OTHER PUBLICATIONS

International Search Report and Written Opinion dated Apr. 7, 2009 for application No. PCT/US09/34993, filed Feb. 24, 2009, Applicant: Prestige Ameritech Ltd., 7 pages.

(Continued)

*Primary Examiner* — Kristen Matter
*Assistant Examiner* — Aundria Hairell
(74) *Attorney, Agent, or Firm* — Geoffrey A. Mantooth

(57) ABSTRACT

A face mask has upper and lower portions made of mask material. The upper and lower portions are joined together at side portions and a front portion. The side portions converge as the side portions extend from a face edge to the front portion. The mask has sections between the face edge and the front portion, with each section having a head retainer, a nose strip or both. The sections are divisible from each other along separation zones or bands that extend between the side edges. The size of the mask can be reduced by removing one or more sections, leaving one or more sections that incorporate the front edge and the shortened side edges.

12 Claims, 8 Drawing Sheets

OTHER PUBLICATIONS http://www.medisave.co.uk/images/shermond__1701__nuisance__mask.jpg., photograph of face mask, 1 page; Nov. 29, 2007.

http://www.ammex.com/pictures/300#20N95CM%20with%20mask.jpg., photograph of cone style face mask, 1 page; Feb. 3, 2009.

* cited by examiner

UNIVERSAL FIT FACE MASK

This application claims the benefit of U.S. Provisional Application Ser. No. 61/031,119 filed Feb. 25, 2008.

FIELD OF THE INVENTION

The present invention relates to face masks of the type used to filter contaminants for a wearer, as well as methods of making the same.

BACKGROUND OF THE INVENTION

Face masks are worn to filter out contaminants and protect the health of the wearer. For example, surgical face masks are worn by medical personnel in operating rooms. The face masks protect the medical personnel from infectious agents that may emanate from a patient undergoing a surgical procedure. In addition, the face masks protect the patient from infectious agents produced by the medical personnel There are several types of face masks. One type is flat. Flat face masks are either pleated or folded to allow for some fitting of the mask to the curvature of a human face. Another type of face mask is "cone" or "cup-shaped" mask. This type is a molded mask.

All face masks need to fit against the face of the wearer. The size of the human face varies greatly from one person to another. Some faces are smaller and require small face masks, while larger faces require larger masks. For example, children have small faces and require smaller masks than adults.

In the prior art, face masks have been made in several sizes. For example, flat face masks have been made in small and large sizes. Stocking several sizes of face masks adds to inventory problems.

In public health crises, such as pandemics, having multiple sizes of face masks can cause problems. Pandemics require large numbers of face masks in a short period of time. Consequently, the masks must be manufactured in advance and stockpiled. Stockpiling masks of a particular size requires some guessing. Public health officials desire to avoid a situation where, during a pandemic or other high need crisis, a particular depot runs out of a particular size of face mask. For example, a depot may run out of child-sized masks, but have adult-sized masks still in inventory. An adult-sized mask will not properly fit a child and thus will not adequately protect.

Thus, what is needed is a face mask that can fit many sizes of faces.

SUMMARY OF THE INVENTION

The present invention provides a face mask that comprises mask material having a face edge and a front portion. The face edge forms an opening to an interior of the mask. The mask material converges from the face edge to the front portion. The face mask also comprises at least two sections, with at least one section located along the face edge and extending toward the front portion and the other section incorporating the front portion and extending toward the one section. When the one section is removed, a second face edge is created, forming a second opening in the mask interior.

In accordance with one aspect of the present invention, each section has a head retainer coupled to the mask material.

In accordance with one aspect of the present invention, the face mask further comprises a nose strip coupled to the mask material in each section.

In accordance with still another aspect of the present invention, the face mask further comprises at least one separation zone on the mask material between the sections.

In accordance with still another aspect of the present invention, the separation zone comprises a pre-scored line on the mask material to assist in tearing the mask material along the separation zone.

In accordance with still another aspect of the present invention, the face mask further comprises a nose strip coupled to the mask material in each section. The separation zone is located between the nose strips.

In accordance with still another aspect of the present invention, the head retainer comprises a head loop.

In accordance with still another aspect of the present invention, the head retainer comprises adhesive.

In accordance with still another aspect of the present invention, the mask is of the flat type.

In accordance with still another aspect of the present invention, the mask is of the cone type.

The present invention also provides a face mask comprising mask material having a face edge and a front portion. The face edge forms an opening to an interior of the mask. The mask material converges from the face edge to the front portion. The face mask also comprises at least two sections, with one section located along the face edge and extending toward the front portion and the other section incorporating the front portion and extending toward the one section. When the one section is removed, a second face edge is created, forming a second opening into the mask interior. Each section has a nose strip coupled to the mask material.

In accordance with one aspect of the present invention, the face mask further comprises at least one separation zone on the mask material between the sections.

In accordance with still another aspect of the present invention, the separation zone comprises a pre-scored line on the mask material to assist in tearing the mask material along the separation zone.

In accordance with still another aspect of the present invention, the separation zone is located between the nose strips.

In accordance with still another aspect of the present invention, the mask is of the flat type.

In accordance with still another aspect of the present invention, the mask is of the cone type.

The present invention provides a method of fitting a face mask to a human face. The face mask is provided with mask material having a face edge and a front portion, the face mask converging from the face edge to the front portion. A second face edge is created that is closer to the front portion than was the face edge. The face mask is donned onto the face.

In accordance with one aspect of the present invention, the step of creating a second face edge further comprises the step of removing an amount of the mask material that extends from the face edge toward the front portion.

In accordance with still another aspect of the present invention, first and second nose strips are provided that are coupled to the mask material. The first nose strip is adjacent to the face edge. The second nose strip is located between the first nose strip and the front portion. The step of removing an amount of the mask material further comprises separating the first nose strip from the mask.

In accordance with still another aspect of the present invention, first and second head retainers are coupled to the mask material. The first head retainer is coupled to the mask material at least one first coupling location. The second head retainer is coupled to the mask material at least one second coupling location. The step of removing an amount of the mask material further comprises the step of separating the first head retainer from the mask.

In accordance with still another aspect of the present invention, the step of creating a second face edge further comprises the step of rolling an amount of the mask material adjacent to the face edge toward the first portion.

DESCRIPTION OF THE PREFERRED EMBODIMENTS

Figure 1:
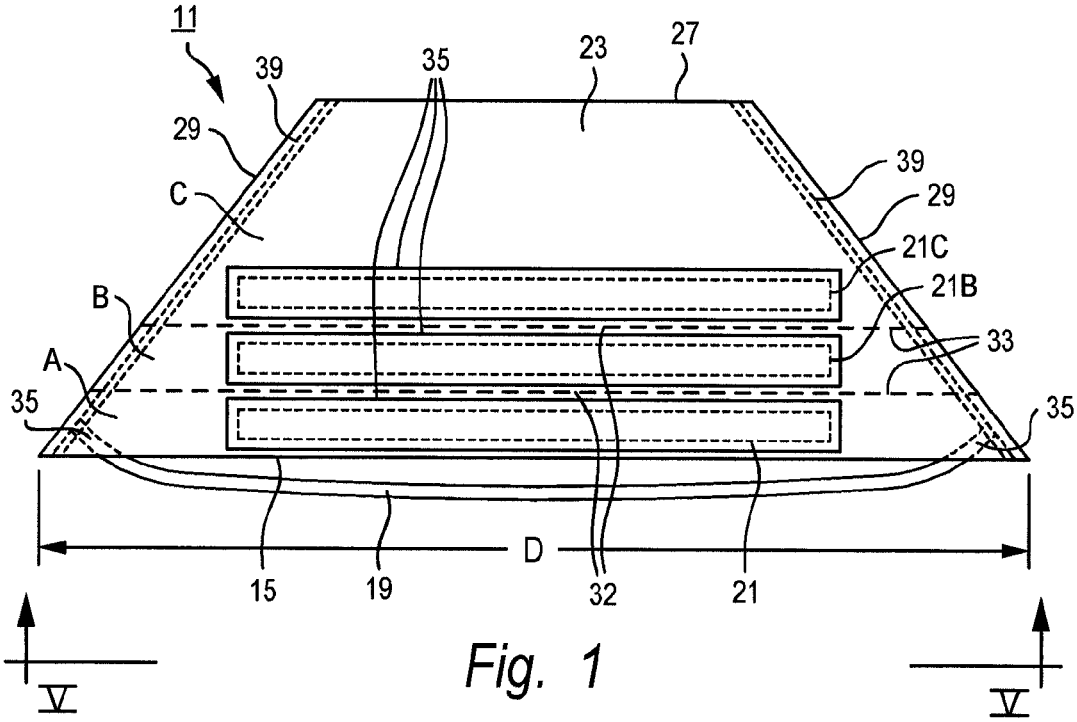
FIG. 1 is a plan view of an upper side of the face mask of the present invention, in accordance with a preferred embodiment, shown at full size.
Figure 2:
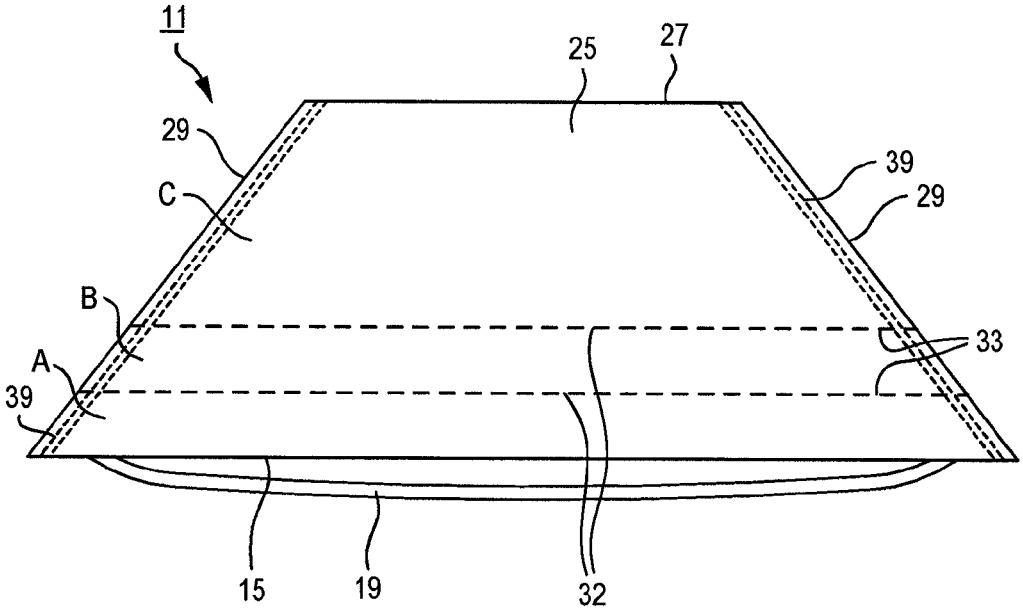
FIG. 2 is a plan view of the bottom side of the face mask of FIG. 1.
Figure 5:
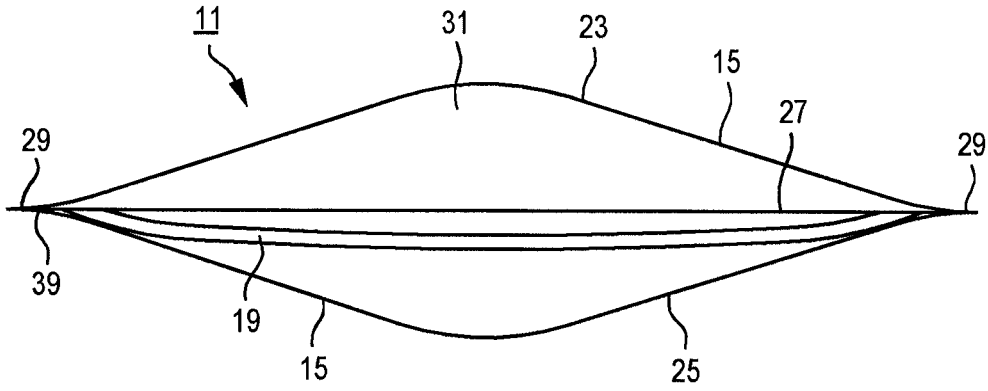
FIG. 5 is a view of the open end of the face mask of FIG. 1, taken at lines V-V and which mask has been opened to apply to a face.

The face mask 11 of the present invention is shown in FIGS. 1 and 2 in accordance with a preferred embodiment. The face mask shown is of the "duckbill" type and has a face edge 15 that contact the wearer's face (see FIG. 5). The face mask 11 of FIGS. 1 and 2 is shown in full size and is suitable for use on a full sized face, such as an adult human male. (The drawings are not necessarily at full scale.) FIG. 5 shows the open end of the face mask 11, from the face edge 15. The face edge 15 forms an opening.

With the face mask 11 of the present invention, a portion or part of the mask can be removed to make an alternative face mask. In accordance with one example, a section of the face mask can be removed so that the face mask will fit a smaller face. In accordance with another example, several head loops or other type of head retainers can be provided; the unused head loops can be removed from the mask, leaving head loops that provide proper fit of the mask to a wearer's face.

Figure 3:
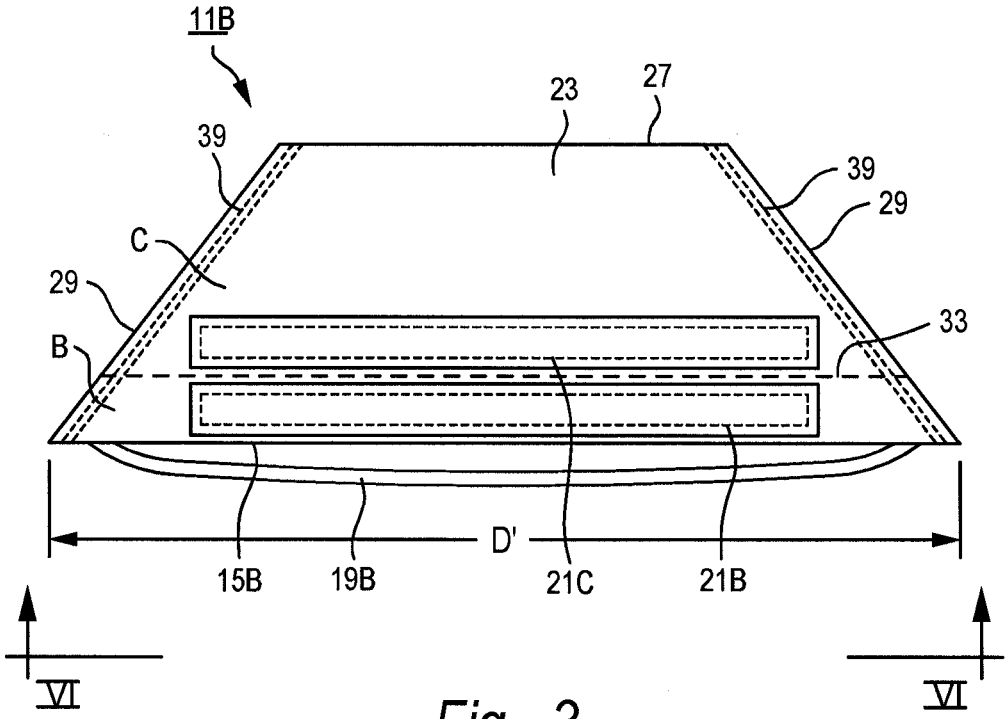
FIG. 3 is a plan view of the upper side of the face mask of FIG. 1, shown after having been reduced to an intermediate size.
Figure 6:
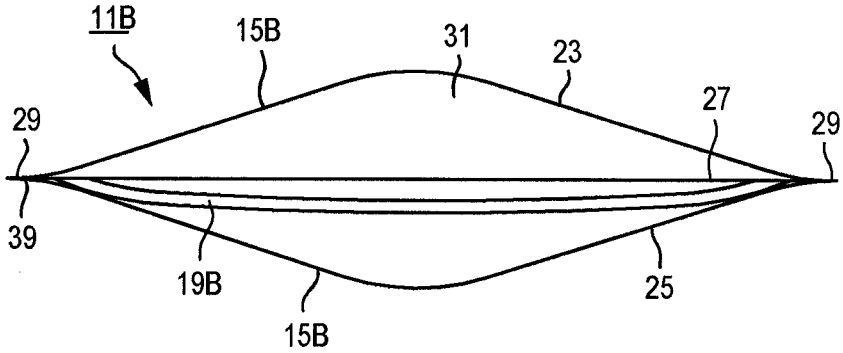
FIG. 6 is a view of the open end of the mask of FIG. 3, taken at lines VI-VI and which mask has been opened to apply to a face.

The size of the mask can be reduced to fit smaller faces. To reduce the size of the mask, a section can be removed. The face mask of FIG. 1 has three sections, namely sections A, B and C. For example, FIG. 3 shows the face mask 11B, after it has been reduced in size. In particular, section A of the face mask 11 has been removed to make a smaller mask 11B, leaving remainder sections B and C. The face mask 11B of FIG. 3 has a smaller face edge 15B and consequently a smaller opening and is suitable for use on an intermediate size face, such as an adult human female. FIG. 6 shows the open end of the mask 11B.

Figure 4:
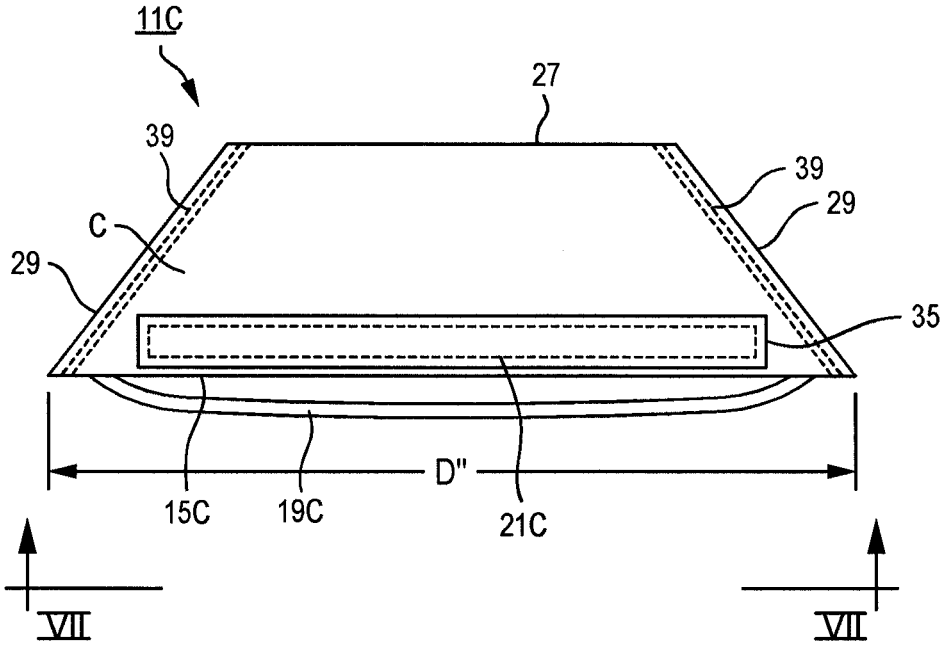
FIG. 4 is a plan view of the upper side of the face mask of FIG. 1, shown after having been reduced to a small size.
Figure 7:
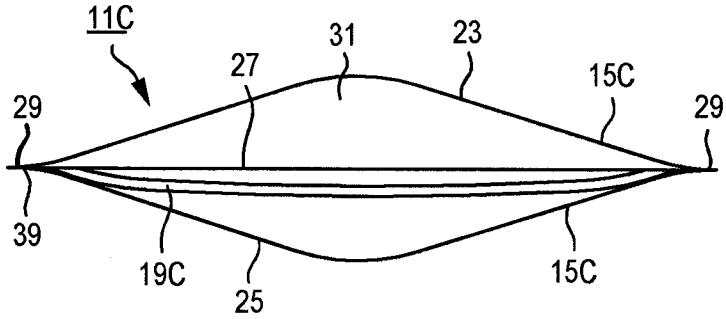
FIG. 7 is a view of the open end of the mask of FIG. 4, taken at lines VII-VII and which mask has been opened to apply to a face.

The face mask can be reduced even further in size to fit on smaller faces, such as human children. FIG. 4 shows the smaller sized face mask 11C. The small sized face mask was achieved by removing sections A and B from the face mask of FIG. 1, or by removing section B from the face mask 11B of FIG. 3, leaving section C. The face mask 11C has a smaller face edge 15C and consequently a smaller opening. FIG. 7 shows the open end of the mask 11C.

Thus, a single face mask can be altered to fit faces of various sizes. As can be seen by comparing FIGS. 1, 3 and 4, and also FIGS. 5-7, the mask can be left at full size or it can be made smaller by removing part of the mask. The part of the mask that is removed incorporates the face edge 15 that is already exposed, wherein a new and shorter or smaller face edge is created on the remainder of the mask. The smaller face edge results in a smaller opening.

The face mask of the present invention reduces the need to stock face masks of several different sizes, thereby simplifying inventory management and also assuring that face masks that will properly fit most faces will be in the inventory.

The face mask will now be described in more detail. The face mask has mask material, head retainers 19, 19B, 19C and nose strips 21, 21B, 21C.

The mask material serves as a filter and is formed into an upper portion 23 and a lower portion 25 (see FIGS. 1 and 2). The mask material can be one or more layers. In one embodiment, the mask material has three layers, namely an inside layer, an intermediate layer, and an outside layer. "Inside" is the part of the mask that can contact the wearer's face, while "outside" is exposed and visible when the mask is being worn. The inside layer can be wet laid cellulose, tissue, or a copolymer such as bico (bicomponent polymers). The inside layer is soft against the skin of the wearer. The intermediate layer is a filter media and can be melt-blown polypropylene or melt-blown polyester. The outside layer can be spun-bonded polypropylene or tissue or a breathable plastic. The outside layer protects the intermediate layer and is more cosmetic than the intermediate layer. Even though the intermediate layer is the primary filter media, all of the layers form a filter media to some extent.

Other layers or capabilities can be provided. For example, a fluid-resistant layer can be provided either as a separate layer, or incorporated into the intermediate layer. Likewise, an anti-microbial layer can be provided, either as a separate layer, or incorporated into the intermediate layer. The fluid resistant layer, which is conventional and commercially available, is a barrier material that can differentiate between gases and liquids. Barrier materials have small apertures which prevent liquids from passing through due to the liquids' relatively high surface tension. The barrier material typically passes gases freely in either direction (from the inside to the outside and from the outside to the inside), while restricting the passage of liquids in at least one direction. The anti-microbial layer has a conventional and commercially available anti-microbial agent. For example, the agent may be iodine-based.

In the embodiment shown in FIGS. 1, 3 and 4, the face mask 11, 11B, 11C is a flat face mask when not in use. Referring to FIG. 1, the mask, when flat, is generally trapezoidal, having the face edge 15, a front edge or portion 27 and side or lateral edges or portions 29. The side edges 29 extend from the face edge 15 to the front edge 27. There is a face edge 15 for the upper portion 23 and another face edge 15 for the lower portion 25 (see FIG. 5); preferably the upper portion face edge and the lower portion face edge form a single continuous face edge. The face edge 15 can be the edge of the mask material, or it can be lined with another material, such as foam. The upper and lower portions are coupled or bonded together at the front edge 27 and the side edges 29. In the preferred embodiment, the front edge 27 is a fold between the upper and lower portions 23, 25, while the side edges 29 are bonded together. The side edges 29 are bonded together in bonded areas 39, which extend along the edges. The bonded areas 39 are illustrated by lines with short dashes. If the mask material has two or more layers, then the layers at the face edge 15 may also bonded together to prevent the layers from separating. An interior cavity 31 (see FIG. 5) is formed between the upper and lower portions 23, 25, and the side edges or portions 29 with an opening at the face edge 15. The face edge 15 contacts the wearer's face while the mask is worn.

When viewed from above or below as in FIGS. 1 and 2, the face edge 15 is longer than the front edge 27. The two side edges 29 converge as they extend from the face edge 15 to the front edge 27.

The mask 11 has two or more sections A, B, C. Each section is provided with either a head retainer (shown as a head loop 19, 19B or 19C) or a nose strip 21, 21B, 21C or both a head retainer and a nose strip to provide a good fit to the face of the wearer. The size of the mask can be made smaller by removing one or more sections. This reduces the size of the opening made by the respective face edge 15, 15B, 15C (see FIGS. 5-7). It also reduces the size of the remainder of the mask, which remainder contains the remaining section or sections. The section or sections that are removed contain the existing and already exposed face edge and when removed create a new face edge on the remaining sections. The remaining sections of the face mask contain the side edges 29, which are shortened, as well as the front edge 27. Thus, removing a section to make the mask smaller does not compromise the integrity of the mask material and its filtering capability.

Both the upper and lower portions 23, 25 of the mask have sections. In the preferred embodiment, the sections of the upper portion 23 correspond to the sections of the lower portion 25. Thus, the upper portion has sections A, B and C and the lower portion has corresponding sections A, B and C. Although in the preferred embodiment, the sections are of equal size between the upper and lower portions, this need not be the case. For example, the sections in the upper portion can be larger than the sections in the lower portion.

Figure 10:
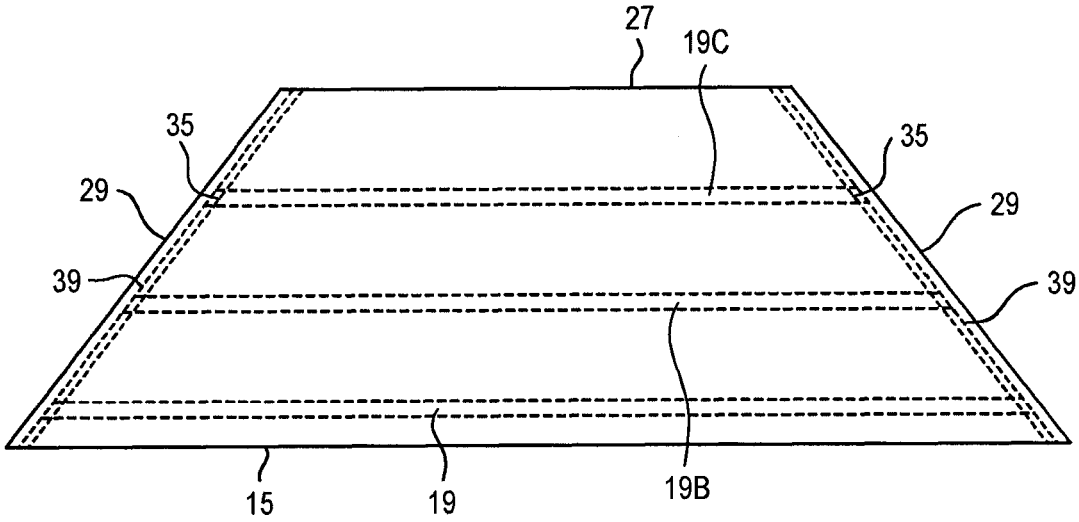

The sections are divisible from each other by separation zones or bands 32. In general, the separation zones 33 are parallel to the face edge 15 and the front edge 27 and extend between the side edges 29. A separation zone 32 can be a separation line 33 (see FIGS. 1-3). The separation lines 33 are visible on the outside of the mask material. In the drawings, the separation lines 33 are illustrated as lines with long dashes in order to visually distinguish over the lines with short dashes that illustrate bonded areas 39 and lines with intermediate dashes that illustrate hidden components, such as nose strips 21, 21A and 21B (FIGS. 1, 3 and 4) as well as head loops 19, 19B, 19C (FIG. 10). Although illustrated as lines with long dashes, the separation lines 33 can be continuous, dashed (of any length), double lines closely spaced, and so on. The separation lines can be visible on both the upper and lower portions, but may only be visible on one of the portions, typically the upper portion 23. A face edge 15B, 15C is formed at the separation lines when the mask is cut or torn along a particular separation line.

The separation zones 32 or lines 33 may be used to assist in separating or removing a section or sections. For example, the separation lines 33 on the mask material can be prescored or weakened to allow a section of mask material to be torn away from the remaining section or sections of the mask. Alternatively, the separation zones or bands can be fitted with a string or strip that, when pulled, decouples the adjoining sections of mask material. For example, a string, when pulled from one end, can rip or tear through the mask material. As another example, a strip is used to join two adjacent sections; when the strip is pulled from one end, the strip tears away from the two sections to uncouple the two sections. As another alternative, the separation lines can simply be lines printed on the outside of the mask. To remove a section, a pair of scissors or a knife cuts along or near the line.

Having a printed or otherwise visible separation zone 32 or separation line 33 is helpful in guiding a user in altering the mask to change size. Some users may not need any guidance. Such users may be familiar with the mask having used the mask before. There, the separation zones need not be printed or otherwise distinguishable from other features on the mask. For example, the separation lines can be incorporated into lines that bond the mask material layers together. As discussed below, finishing layers 35 are used to couple nose strips 21, 21A, 21B to the mask material. The finishing layers are coupled to the mask material by bonding, such as ultrasonic bonding. The lines used to bond the layers 25 can serve as the separation lines or zones. Alternatively, the separation zones can be the spacing located between the nose strips 21, 21B, 21C. A user could reduce the size of the mask by cutting between two adjacent nose strips, from side edge to side edge.

To remove a section and change the size of the mask, both the upper and lower portions of that section are removed. Removal of a section creates a new face edge that is shorter in length than the original face edge. For example, referring to FIGS. 1 and 3, removing section A to make the mask into an intermediate size reduces the length of the upper portion face edge 15 from length D (see FIG. 1) to upper portion face edge 15A of length D' (see FIG. 3). Likewise, the side edges 29 are shorter. However, the front edge 27 is unchanged in length. Also, the width of the face mask, from the front edge 27 to the new face edge 15B is smaller than the full size face mask 11 shown in FIG. 1. As another example, referring to FIGS. 1 and 4, removing sections A and B to make the mask into a small size reduces the upper portion face edge 15 from length D (see FIG. 1) to upper portion face edge 15C of length D" (see FIG. 4). The side edges 29 are also shortened in length. However, the length of the front edge 27 remains unchanged. The width of the face mask between the front edge 27 and the new face edge 15C is smaller than either the intermediate size mask 11B of FIG. 3 or the full size mask 11 of FIG. 1.

The face mask 11, 11B, 11C is kept against the face by a head retainer. The head retainer can be a head loop 19, 19B, 19C. In addition, the face mask 11, 11B, 11C has a nose strip 21, 21B, 21C near the respective face edge for conforming the upper portion face edge about the contour of the nose. In the preferred embodiment, each section A, B, C of the face mask has a respective head loop 19, 19B, 19C and a respective nose strip 21, 21B, 21C.

The head loops 19, 19B, 19C are an elastic knitted material or a plastic elastomer. Each head loop has ends 35 (see FIGS. 1, 9 and 10) that are coupled to the mask. In the preferred embodiment, the ends are located in the bonded portion 39 of the side edges 29. The ends 35 are located in the side edges of their respective section. For example, as shown by FIG. 1, the ends (shown by dashed lines in FIG. 1) of the head loop 19 to be used with section A are located in the bonded 39 side edges of section A. Alternatively, the ends could be located on the outside of the mask, in the respective section. The head loops typically vary in length, with the section A head loop 19 being longer than the sections B and C head loops 19B, 19C and the section C head loop 19C being the shortest.

There could be more than one head loop per section. For example, two head loops per section can be used. With two loops, one head loop extends around the back of the head, while the other head loop extends around the top of the head. Also, the larger sections (such as sections A and B) can be provided with two head loops, while the smaller sections (such as section C) can be provided with one head loop. Thus, the number of head loops can vary from section to section.

As an alternative, there could be fewer head loops or head retainers than sections. For example, the mask of FIG. 1 could be provided with a single head loop, the ends of which are coupled to the mask at section C. To use, the head loop is pulled out. Removal of sections A and B would not remove the single head loop.

Another alternative to continuous loops are ties. A tie is two lengths of material; each length has an end bonded or secured to the respective section as described above with respect to head loops. The other ends are free and are tied together about the head to form a loop. Ties are typically provided in pairs. A section could contain one or more pairs of ties. As used herein, loops and ties are collectively referred to as "head loops" or "loops".

Other types of head retainers can be used besides head loops (and ties), which retainers keep or hold the mask against the face of the wearer. For example, ear loops can be used. An ear loop is a length of material, such as an elastic knitted material or a polymer elastic, which is looped around an ear. The two ends are coupled to the same side of the face mask. Each side of the face mask has an ear loop. The ends of the ear loop can be either in the inside of the mask (within the bonded side edges) or on the outside. Each section of the face mask has a pair of ear loops; one ear loop for the right ear and the other ear loop for the left ear. The unused ear loops can be cut off to avoid tangling or dangling.

Figure 13:
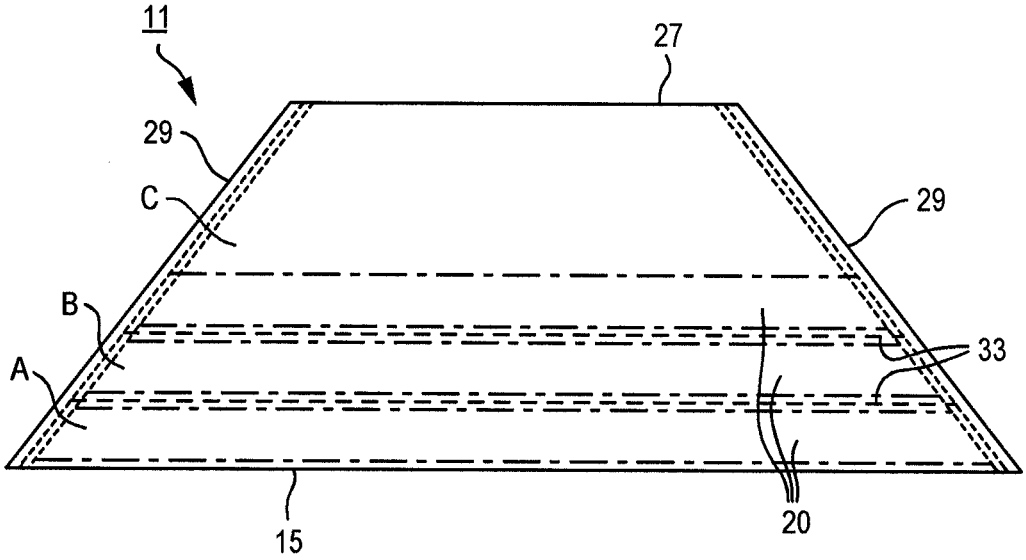
FIG. 13 is a plan view of the face mask, in accordance with another embodiment.
Figure 14:
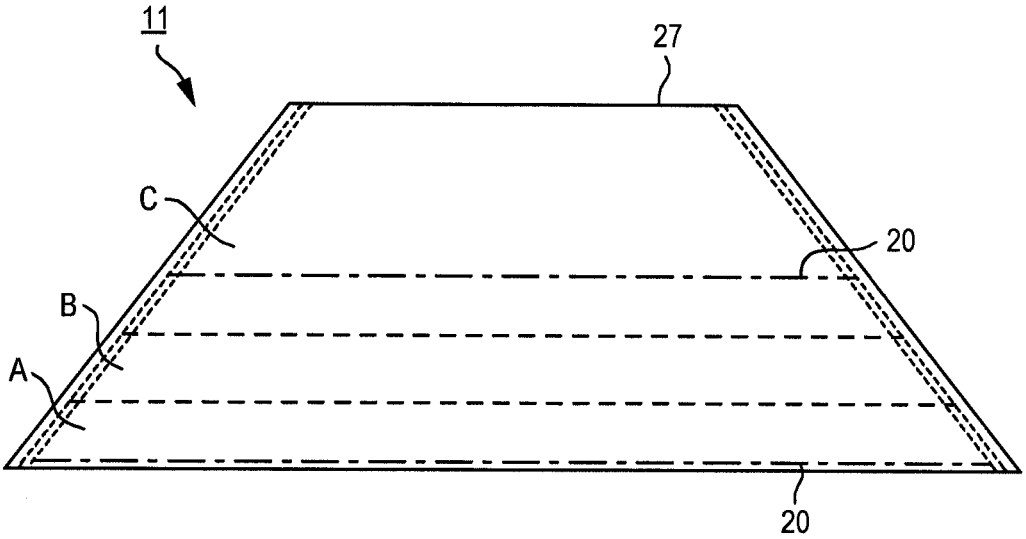
FIG. 14 is a plan view of the face mask, in accordance with still another embodiment.

Still another type of head retainer is adhesive 20 (see FIG. 13). The adhesive is located on the inside of the mask at or near the face edges (the adhesive 20 is shown by dash-dotted lines in FIGS. 13 and 14). Both the upper and lower portions 23, 25 of the mask have adhesive. The adhesive is of the type that when the mask is worn, the adhesive contacts and sticks to the face of the wearer. The adhesive can be covered with a peelable backing layer to prevent the upper and lower portions of the mask from sticking or adhering together before the mask is worn. To expose the adhesive, the backing layers are peeled off; the mask can then be applied to the face. Some pressure may be needed to cause the adhesive to stick to the face. The adhesive 20 can be in a solid sheet that extends across the separation lines 33 as shown in FIG. 14, with the upper portion of the mask having an adhesive sheet and the lower portion having an adhesive sheet. Alternatively, the adhesive can be discontinuous or perforated to allow the user to breathe through the adhesive portion of the mask. FIG. 13 shows the adhesive 20 in strip form with slots between the strips (and along the separation lines 33). The adhesive 20 could be a sheet with perforations therein. With adhesive, nose strips need not be used.

The mask will be described in further detail using head loops as an example of head retainers.

The head loops are located within the sections. In FIGS. 1-4, the head loops nearest the face edges have been pulled out for illustrative purposes. In the other sections, the head loops are still inside of the sections. For example, in FIG. 1, the head loop 19 associated with section A shown is pulled out from the mask interior; the ends 35 are bonded at the side edge bonded areas. FIG. 10 shows the head loops 19, 19B, 19C (by short dashed lines) located within their respective sections (in FIG. 10, which illustrates a step in the manufacturing process, the separation lines 32 have not yet been applied to the mask). Sections B and C have similar head loops located in the respective sections. When a wearer with a large face dons the mask of FIG. 1, the section A head loop 19 is pulled out and extended around the wearer's head, while the sections B and C head loops 19B, 19C are kept inside of the mask. Likewise, when a wearer with a medium size face mask dons the mask 11B of FIG. 3, the section B head loop 19B is pulled out and extended around the wearer, while the section C head loop 19C is kept inside of the mask. Section A and its head loop have been removed. Keeping the head loops within their respective sections allows the section to be separated or cut along the respective separation lines 33 without cutting the respective head loop. For example, making an intermediate face mask from a full size face mask involves removing section A; the section B head loop 19B is located inside of section B and does not cross the separation line 33 separating sections A and B. That way if the mask is cut along the separation line between sections A and B, then the head loop 19B is not likely to be cut. When the sections are separated by tearing, then the placement of the head loops within the respective sections is not as important. As shown in FIG. 10, the head loops 19, 19B, 19C are of unequal length, with the head loop 19 being the longest and the head loop 19C being the shortest. This allows each head loop to extend in a fairly straight line between the side edges 29. Alternatively, the head loops could be of equal length.

Each section has a nose strip 21, 21B, 21C as well, located near the upper portion 23 face edge 15, 15B, 15C of the respective section (see FIGS. 1, 3 and 4).

Each nose strip is semi-rigid, deformable or malleable and is designed to fit around the nose of the wearer. The nose strip is typically made of aluminum. The nose strip 21B is between the nose strip 21 and the front edge or portion 27. The strip 21C is between the two nose strips 21, 21B and the front portion 27. The nose strips 21, 21B, 21C can be of equal length or can vary in length, with the longest nose strip 21 being in section A and the shortest nose strip 21C being in section C. In one embodiment, the nose strip is located between the outside layer of the mask material and a finished layer. The finished layer is a separate binding layer 35 or a strip, which can be made of the same material as either the outside or inside layers. Preferably, there are separate finished layers or strips 35, one for each nose strip 21, 21B, 21C. A single finished layer can be used for all of the nose strips, but it may make separation of the sections more difficult.

To make the face mask 11, the layers of the mask material are brought together and cut into shape, fitted with the head loops 19, 19B, 19C, bonded at the side edges 29, fitted with the nose strips 21, 21B, 21C and marked with the separation lines 32. The side edges 29 can be bonded together by ultrasonic bonding, by heat and pressure or by adhesives.

Figure 8:
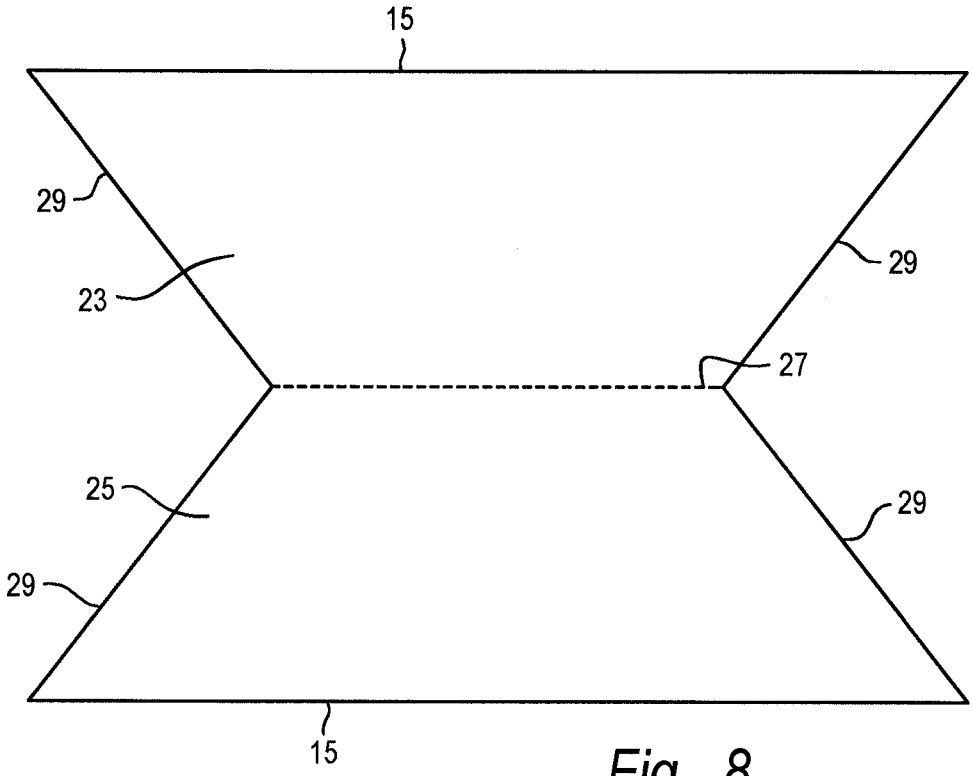
FIGS. 8-10 are illustrations showing various steps in the manufacture of the face mask of FIG. 1.
Figure 9:
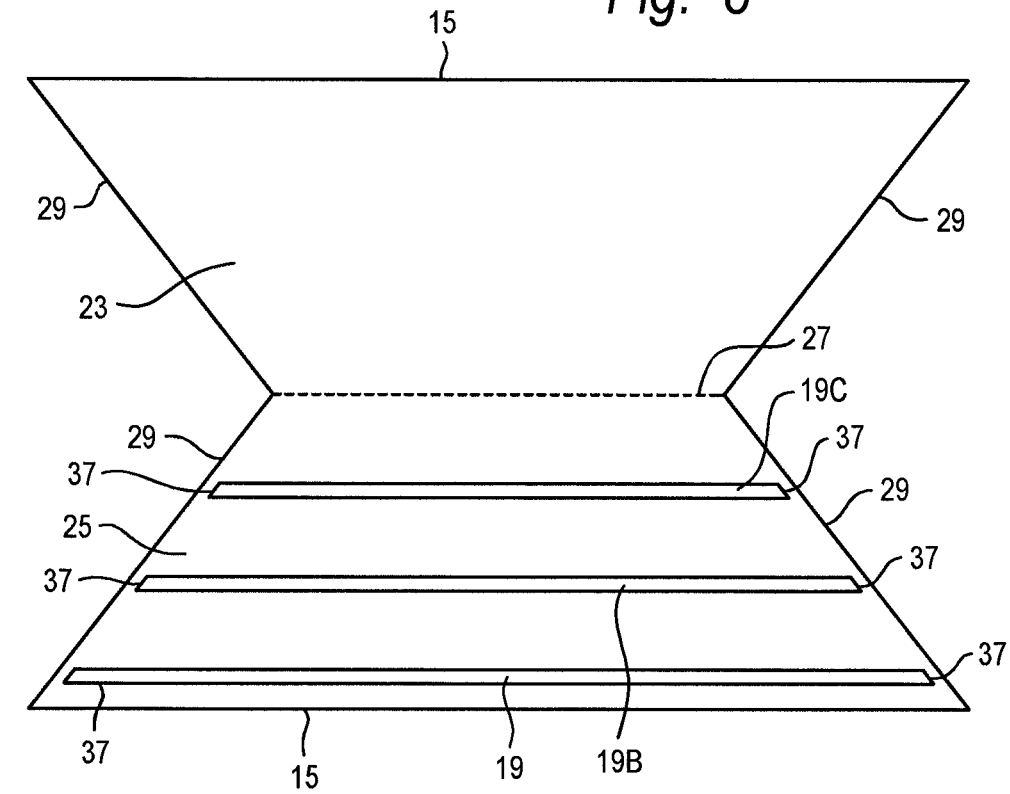

The layers of the mask material are provided in a continuous web, typically contained on rolls. The layers are unrolled and brought together. The layers are then cut into a "butterfly" or double trapezoid shape, as shown in FIG. 8. The upper portion 23 forms one trapezoid while the other portion 25 forms the other trapezoid. Also shown is a fold line 27, the outside of which will form the front edge 27 when the two portions are brought together. FIGS. 8 and 9 show the inside layer of the mask material. If the mask material is made of two or more layers, then the layers of the upper portion 23 may be bonded together at the face edge 15. Likewise, the layers of the lower portion 25 are similarly bonded together.

Lengths of head loop material 19, 19B, 19C are laid against one of the inside layers of either the upper or lower portion (see FIG. 9). The ends 37 of the head loops are located adjacent to the side edges 29. The mask material is then folded at the fold line 27 to bring the upper portion 23 adjacent to the lower portion 25 so as to cover the head loops. The side edges 29 are then bonded together such as by ultrasonic bonding, which forms the bonded areas 39 (see FIG. 10). To bond ultrasonically, the mask material is passed between a set of rollers. One roller has an ultrasonic horn shaped as the side edges. The other serves as an anvil. The ultrasonic bonding creates a bond area 39 that extends inwardly for a short distance from the side edges 29, as shown in FIG. 10. The ends 37 of the head loops are captured within the bonded areas 39.

Next, a nose strip 21, 21B, 21C is put onto each section of the upper portion 23 (see FIG. 1). The nose strips are covered with finishing layer strips 25, which strips are then bonded to the mask material by ultrasonic bonding, heat and pressure or adhesives.

If separation lines 33 are to be used, then they are applied to the outside of the mask material. If the separation lines are prescored, then the mask is passed through prescoring rollers. If the separation lines are tear strips, then each tear strip is prescored along the sides of the strip. A strip or string with a higher tensile strength than the mask material is coupled to the inside layers before the folding step. If the separation lines 33 are guidelines for cutting, then the lines are printed on the outside layer of the mask material. The nose strips are spaced from the separation lines by a short distance. The separation lines 33 can be applied or added to the mask material at any step of the manufacturing process.

The mask is now ready for use.

To use the face mask, the proper size is determined. This can be achieved by guessing or by fitting. To fit the mask, the mask is opened by spreading the face edge 15 apart (see FIG. 5). The open mask is placed over the nose and mouth of the prospective wearer. If it is the proper size, and need not be reduced in size, then the head loop 19 is pulled out of the inside and passed behind the head. The face edge 15 is brought into contact with the wearer's face, with the lower portion 25 of the face edge extending under the chin and the upper portion 23 of the face edge extending over the nose. The nose and mouth are covered by the mask. The nose strip 21 is pressed to contour about the nose. The wearer breathes through the mask. The nose strips 21B, 21C and head loops 19B, 19C for the other sections B, C remain intact.

If the mask is too large, the face edge 15 does not fully contact the face; gaps typically occur where air can pass through unfiltered. One or more sections can be removed. Section A is removed from the mask to make the mask fit a medium sized face, while section A and B are removed to make the mask fit a smaller face such as a child. Removing a section occurs by severing the upper and lower portions 23, 25 of mask material along or close to the proper separation line 33. The mask material can be torn or cut along or close to the separation line 33. The remaining section (C) or sections (B and C) are used while the unused section or sections are discarded. To use the remaining section or sections, the newly created face edge 15B or 15C is pulled apart (see FIGS. 6 and 7) to create the face opening, the respective head loop 19B, 19C is pulled out and passed behind the head and the respective face edge 15B, 15C is brought into contact with the face as described above.

Although the face mask has been shown and described as having three sizes, it may have two or more sizes. The trapezoidal shape, with the side edges 29 converging to the front edge 27, is well suited for reducing the size of the mask by removing material from the long face edges and still maintaining the integrity of the couplings between the upper and lower portions 23, 25 along the side edges 29 and the front edge 27. This maintains the effectiveness of the mask to serve as a filter, while assuring a good fit of the mask to the smaller sized face of the wearer.

The face mask can have other shapes that converge in a non-trapezoidal manner. For example, the mask could be arcuate, with curved sides 29 and either a straight front edge 27 or a curved front edge. In an arcuate face mask having curved side and front edges, the side and front edges may merge without the need for corners as shown in FIG. 1.

The face mask can have gaskets near the face edges of each section. The gaskets, which reduce the passage of liquids through the mask, are located on the inside of the mask at or near the face edges. The gaskets can be made of foam plastic. There could be a single gasket layer for each of the upper portion and lower portion which extends along all of the face edges and separation lines. When cut or torn along a separation line, the gasket layer is also cut or torn. Alternatively, the gasket can be provided in strips, with a strip for each section located at the respective face edges. Providing the gasket in strip form creates a space of breathability where air can pass between the gasket strips.

Although the face mask of the preferred embodiment has been described as flat when not in use, it need not be flat. The mask can be somewhat rigid or stiff to the extent needed to keep an open shape. For example, the mask can be a duckbill shape (see FIGS. 5-7) or a cone shape (see FIG. 11). Such shapes are accomplished by molding the mask material.

Like reference numbers in the embodiments designate like parts.

Figure 11:
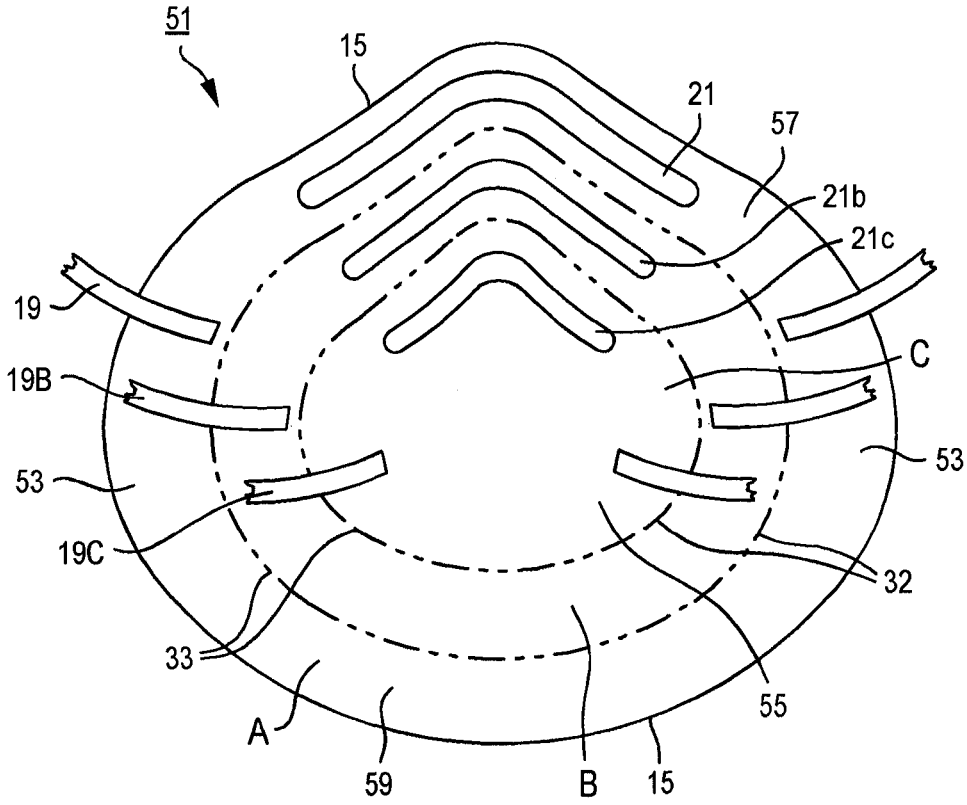
FIG. 11 is a view of the front of the face mask of the present invention, in accordance with another embodiment.
Figure 11A:
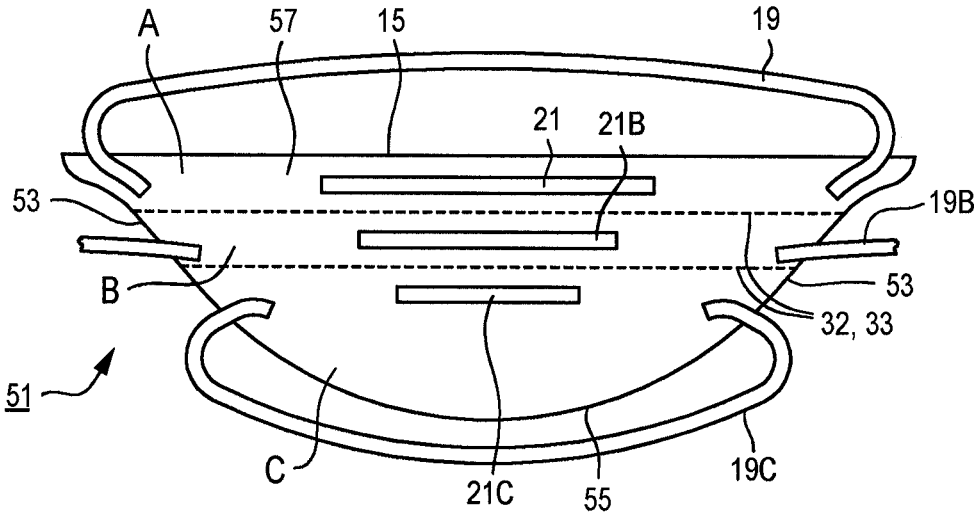
FIG. 11A is a top view of the face mask of FIG. 11.

As shown in FIGS. 11 and 11A, a cone shaped mask 51 has side portions 53 instead of side edges and a front portion 55 instead of a front edge. The cone shaped mask has upper and lower portions 57, 59. Altogether, the mask forms a cone where the side portions 53 converge as they extend from the face edge 15 to the front portion 55. In addition, the upper and lower portions 57, 59 converge as they extend from the face edge to the front portion 55. The face edge 15 is somewhat circular in shape. FIGS. 11 and 11A show the outside of the face mask 51.

The mask 51 has sections A, B, and C, which are divisible by separation zones 32 between the sections. When a section is removed, such as section A, a new face edge is created. In the embodiment of FIG. 11, the separation zones 32 are shown as separation lines 33.

The mask 51 has a nose strip 21, 21B, 21C in each section. The nose strips 21, 21B, 21C are secured in place by glue or adhesive. The mask 51 has at least one head retainer. In the embodiment shown, the head retainer is one or more head loops. The head loops 19, 19B, 19C, shown as cut away in FIG. 11 for illustrative purposes, are typically coupled to the outside of the mask. The head loops that are not in use can be tacked in place on the mask outside to prevent loose loops. Alternatively, the unused head loops can be cut or pulled off the mask. As with the flat mask, the head retainer can be ties, ear loops or adhesive. Alternatively, the head retainer can be a single head retainer such as a head loop 19' (or tie). Such a loop would be coupled to all the sections, such as by adhesive.

Figure 11B:
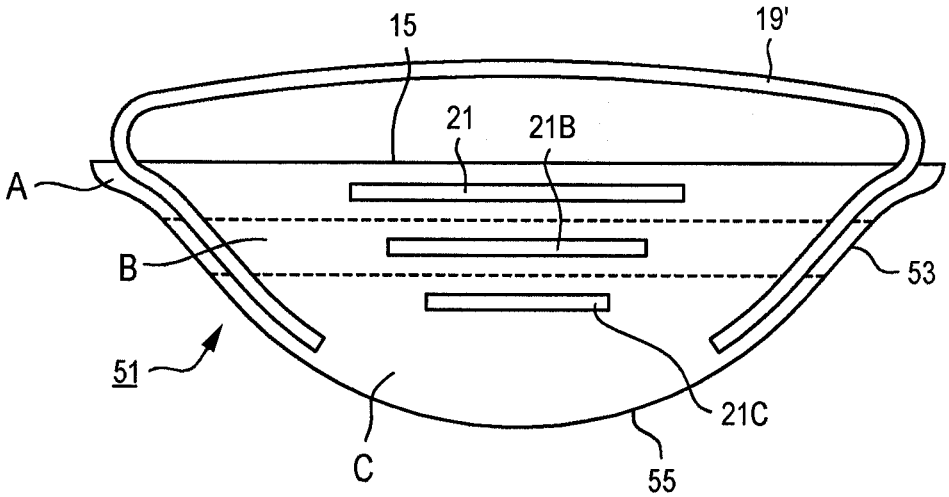
FIG. 11B is a top view of the face mask of FIG. 11, shown modified.

FIG. 11B shows such a mask. If a section was removed, then the head loop 19' would be uncoupled from that section, while still being coupled to the remaining section or sections. If the mask 51 in FIG. 11B was reduced to the smallest size, C, the head loop 19' may be too big to cause a snug fit around the wearer's head. If so, the head loop 19' can be cut to form two ties which are tied together around the smaller head.

Where the flat face mask allows a section to be removed by tearing or cutting the upper and lower portions at the same time, with an open or molded mask, the upper portion and lower portion sections can be removed one at a time or sequentially. A cut or tear can begin in one location and extend around the circumference of the mask material to create a new face edge. If the mask is not too stiff, then the open end can be pinched together while the section is removed.

Figure 12:
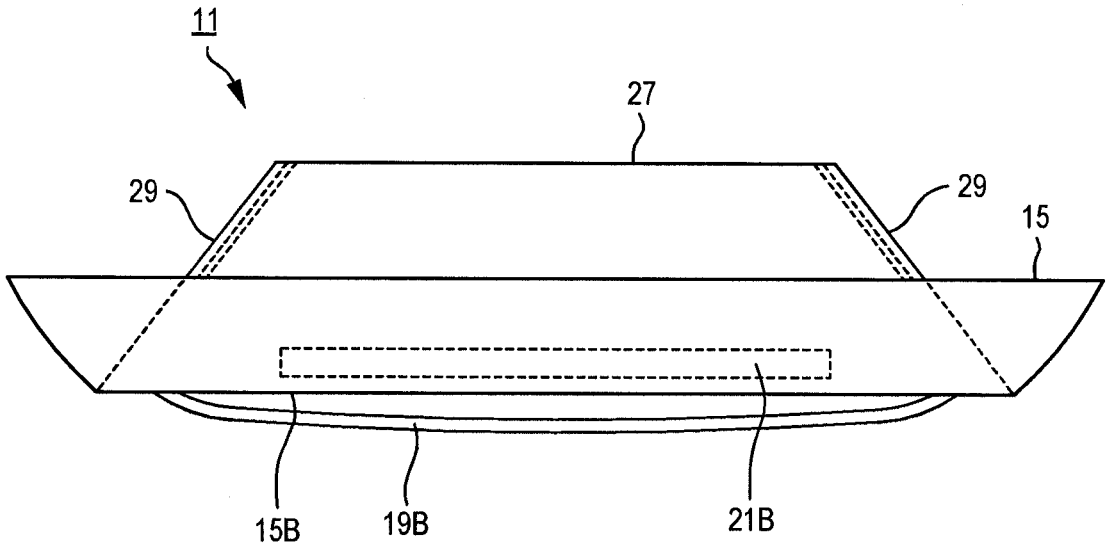
FIG. 12 is a plan view of the face mask of FIG. 1, shown in a folded condition, in accordance with another embodiment.

Cutting or tearing a section creates a new face edge and removes that section from the remainder of the mask. New face edges can be created by rolling or folding the mask material. For example, referring to FIGS. 1 and 12, the mask material that is adjacent to the face edge 15 (for example, Section A) is rolled or folded toward the front edge 27. FIG. 12 shows the inside layer of the rolled section. A new face edge 15B is created, which face edge makes a smaller opening (see the opening size in FIG. 6). The head loop 19B is pulled out and the nose strip 21B is contoured about the bridge of the wearer's nose. The separation zones 32 or lines 33 can be used to assist in folding or rolling the unused sections in order to create a new face edge and a smaller opening to fit onto the face.

The foregoing disclosure and showings made in the drawings are merely illustrative of the principles of this invention and are not to be interpreted in a limiting sense.

The invention claimed is:

1. A face mask, comprising:

a) filter mask material having a face edge and a front portion, the face edge forms a first opening to an interior of the mask, the mask material converging from the face edge to the front portion;

b) the filter mask material comprising at least two sections, with one section located along the face edge and extending toward the front portion and the other section incorporating the front portion and extending toward the one section, wherein when the one section is removed, a second face edge is created, forming a second opening into the mask interior, with the second opening smaller than the first opening;

c) at least one separation zone on the filter mask material between the sections;

d) the at least one separation zone comprises a visible predetermined tearable line on the filter mask material to assist in tearing the filter mask material along the separation zone;

e) a nose strip coupled to the mask material in each section; and f) the at least one separation zone is located between the nose strips.

2. The face mask of claim 1 wherein each section has a head retainer coupled to the mask material, wherein when the one section is removed, the respective head retainer in the one section is removed.

3. The face mask of claim 2 wherein the head retainer comprises a head loop.

4. The mask of claim 2 wherein the head retainer comprises adhesive.

5. The face mask of claim 1, wherein when the one section is removed, the respective nose strip in the one section is removed.

6. The face mask of claim 1 wherein the mask is of the flat type.

7. The face mask of claim 1 wherein the mask is of the cone type.

8. A face mask, comprising:

a) filter mask material having a face edge and a front portion, the face edge forms an opening to an interior of the mask, the mask material converging from the face edge to the front portion;

b) at least two sections, with one section located along the face edge and extending toward the front portion and the other section incorporating the front portion and extending toward the one section, wherein when the one section is removed, a second face edge is created, forming a second opening into the mask interior;

c) each section having a nose strip coupled to the mask material, wherein when the one section is removed, the respective nose strip in the one section is removed;

d) at least one separation zone on the filter mask material between the sections;

e) the at least one separation zone comprises a visible predetermined tearable line on the filter mask material to assist in tearing the filter mask material along the separation zone; and f) the at least one separation zone is located between the nose strips.

9. The face mask of claim 8 wherein the mask is of the flat type.

10. A face mask, comprising:

a) a first side and a second side, the first and second sides made of filter material and each having a face edge, a front portion and side edges, the first and second sides coupled together along the side edges and the front portions, the face edges forming a first opening into an interior between the first and second sides, the side edges converging from the face edges to the front portions;

b) the first and second sides having a first section extending from the face edges toward the front portions, the first and second sides having a second section extending from the front portions toward the first section;

c) a separation line located on at least one of the first and second sides and extending between the first and second sections, the separation line extending between the side edges;

d) a head retainer;

e) a first nose strip coupled to the filter material in the first section on the first or second side and a second nose strip coupled to the filter material in the second section on the same respective side; and f) the separation line comprises a visible predetermined tearable line to assist in tearing the filter material along the separation line.

11. The face mask of claim 10 wherein the head retainer is a first head retainer coupled to the filter material in the first section, further comprising a second head retainer coupled to the filter material in the second section.

12. The face mask of claim 10 wherein:

a) the first and second sides further comprise a third section intermediate the first and second sections;

b) the separation line is a first separation line between the first and third sections, further comprising a second separation line between the second and third sections, and extending between the side edges.

* * * * *